US006546599B2

(12) United States Patent
Pelt et al.

(10) Patent No.: US 6,546,599 B2
(45) Date of Patent: Apr. 15, 2003

(54) GOLF GLOVE SAVER

(76) Inventors: Ralph Pelt, 304 Sunset Dr., Hemphill, TX (US) 75948; Nellene Pelt, 304 Sunset Dr., Hemphill, TX (US) 75948

( * ) Notice: Subject to any disclaimer, the term of this patent is extended or adjusted under 35 U.S.C. 154(b) by 0 days.

(21) Appl. No.: 09/922,653

(22) Filed: Aug. 7, 2001

(65) Prior Publication Data

US 2003/0029006 A1 Feb. 13, 2003

(51) Int. Cl.[7] ..... A44B 18/00; A44B 21/00; A45F 5/00

(52) U.S. Cl. ..... 24/3.1; 24/3.13; 24/66.1; 24/303; 224/222; 224/250

(58) Field of Search ..... 24/3.1, 3.5, 3.13, 24/66.1, 303, 904; 224/222, 272; 362/105, 106

(56) References Cited

U.S. PATENT DOCUMENTS

| | | | | | |
|---|---|---|---|---|---|
| 1,382,446 | A | * | 6/1921 | Warren | 224/222 |
| 2,319,292 | A | * | 5/1943 | Boggs | 24/66.1 |
| 3,148,812 | A | * | 9/1964 | Hilsinger, Jr. | 24/3.1 |
| 3,529,328 | A | * | 9/1970 | Davison | 24/66.1 |
| 3,741,376 | A | * | 6/1973 | Brown et al. | 24/3.1 |
| 4,399,934 | A | | 8/1983 | Dupont | |
| 4,893,739 | A | | 1/1990 | Conner | |
| 4,901,406 | A | * | 2/1990 | Shelby et al. | 24/3.1 |
| D329,744 | S | | 9/1992 | Moore | |
| 5,143,371 | A | | 9/1992 | Strahan | |
| D332,176 | S | | 1/1993 | Mueller | |
| 5,186,373 | A | * | 2/1993 | Taylor | 24/303 |
| 5,653,276 | A | | 8/1997 | Niernberger | |
| 5,682,653 | A | * | 11/1997 | Berglof et al. | 24/303 |
| 5,794,313 | A | * | 8/1998 | Parsons | 24/3.13 |
| 5,794,767 | A | | 8/1998 | Wilson | |
| 5,864,925 | A | | 2/1999 | McGee | |
| D409,379 | S | | 5/1999 | Ellis | |
| 5,934,530 | A | | 8/1999 | Antczak | |
| 5,964,386 | A | * | 10/1999 | Cote | 224/250 |
| D416,134 | S | | 11/1999 | Cloutier | |
| 6,014,775 | A | | 1/2000 | Missry | |
| 6,163,889 | A | | 12/2000 | Tate | |
| 6,202,911 | B1 | | 3/2001 | Freer | |

FOREIGN PATENT DOCUMENTS

| | | |
|---|---|---|
| FR | 2 674 110 | 9/1992 |
| GB | 227180 | 1/1925 |
| GB | 354464 | 8/1931 |

* cited by examiner

*Primary Examiner*—Victor Sakran
(74) *Attorney, Agent, or Firm*—Richard C. Litman

(57) ABSTRACT

A golf glove saver device for drying out a golf glove wet from perspiration while playing on a golf course. The planar device is flexible and elongate, being foldable about a medial line to define first and second portions, each portion containing a magnet so that the device can be looped about a pocket, waistband, belt, or other article of clothing and secured by attraction of the magnets. A patch of hook and loop fastening material is attached to the outer face of the golf saver device. The golf glove is attachable to the hook and loop fastening material.

4 Claims, 4 Drawing Sheets

GOLF GLOVE SAVER

BACKGROUND OF THE INVENTION

1. Field of the Invention

The present invention relates generally to accessories for golfers. More specifically, the invention is a device for holding the golf player's wet glove adjacent one's pants' pocket or belt between drives to aid in drying out the wet glove.

2. Description of the Related Art

The related art of interest describes various article holding devices, but none discloses the present invention. There is a need of a simplified solution for drying wet golf gloves during play on the golf course instead of supplying oneself with multiple gloves. The related art will be discussed in the order of perceived relevance to the present invention.

U.S. Design Pat. No. 409,379 issued on May 11, 1999, to Thomas J. Ellis describes a decorative golf glove holder comprising, as best understood, a foldable rectangular holder having a square patch assumed to be either hook and loop fastening material on the outside of one portion. The inside portion can have either a clip and protruding button or a pair of snaps which would suggest wearing on a belt and not in a pocket. The glove holder is distinguishable for requiring clips or snaps which can damage the golfer's clothing.

U.S. Design Pat. No. 416,134 issued on Nov. 9, 1999, to Kenneth F. Cloutier describes a decorative golf glove holder comprising, as best understood, a rectangular base with an upper overhanging portion (or belt clip) to hang on a belt and two perforated lugs on the bottom to secure two golf tees. A rectangular piece of hook and loop fastening material is located between the two lugs presumably to attach a golf glove. The holder is distinguishable for using a belt clip securing the holder to a belt by friction.

U.S. Pat. No. 5,934,530 issued on Aug. 10, 1999, to Gordon W. Antczak et al. describes a golf accessory organizer comprising a plastic belt clip which can hold tees, golf balls, golf gloves, divot tools, ball markers, and other small golfing accessories. The outside edges of the clip can have hook and loop patches to hold sunglasses, golf gloves or a divot tool. The organizer is distinguishable for its required features to hold various articles.

U.S. Pat. No. 5,143,371 issued on Sep. 1, 1992, to Ronald L. Strahan describes a golfer's aid in the form of clip which can be attached to a belt, pocket or waistband of a golfer or to a golf bag and the like article. A strip of hook and loop fabric is attached to the straight outer surface of the clip for attaching a golfer's glove. A blade is rotatably attached to the end of the clip. One end of the blade is a divot repair tool and the opposite end is a curved surface for checking the roundness of a golf ball. One square tooth and one pointed tooth are also provided on the arms of the divot repair tool. A hole surrounded by a magnet may be provided in the clip above for receiving the spike of a ball marker. The clip is distinguishable for its required various tools.

U.S. Pat. No. 5,794,767 issued on Aug. 18, 1998, to Earl Wilson describes a gripping holder for cigarette lighters and the like comprising a small rubber hollow shaped cylinder in two rectangular rubber sheets creating a sandwich about two side-by-side magnets for holding paper currency. The device is distinguishable for being limited to a money clip.

U.S. Design Pat. No. 332,176 issued on Jan. 5, 1993, to John Mueller describes a decorative golf accessory holder comprising a belt with a semicircular zippered storage box with snaps on its sides, a hook and loop patch to hold a golf glove on one side and a pencil holder loop on the other side. The holder is distinguishable for its required manifold accessory holding features.

U.S. Pat. No. 6,014,775 issued on Jan. 18, 2000, to Ezra Missry describes a magnetic golf glove comprising a pair of magnets contained in the fastening flap to accelerate blood flow. The glove is distinguishable for its required magnets.

U.S. Pat. No. 6,163,889 issued on Dec. 26, 2000, to John R. Tate describes a golf ball marker, a golf divot tool, a golf glove's closure flap, a golf towel, a golf pencil with a ferrous band or other small articles are attracted by magnets carried in open display on a fabric article of clothing or other fabric accessory. The magnetic articles are distinguishable for not including a foldable wallet sized magnetic retainer for insertion in a pocket.

U.S. Pat. No. 5,864,925 issued on Feb. 2, 1999, to Robert W. McGee describes a golf glove attachment device comprising a thin rectangular plastic card with hook and loop fastening patches on the front and back connected to a spring-loaded reel mechanism with a clip attached to the golfer's belt. The device is distinguishable for its reliance on a spring-loaded reel mechanism carrying a retractable cord.

U.S. Pat. No. 5,653,276 issued on Aug. 5, 1997, to Howard A. Niernberger describes a combination wallet and billfold using closures such as either hook and loop fastening, a metal clip and eye-type fastener or a magnetic element. The wallet is distinguishable for not being installed to overlap a pocket.

U.S. Pat. No. 4,893,739 issued on Jan. 16, 1990, to Gail B. Conner describes a golf ball and accessory pouch for carrying golf balls, a pencil, golf tees, a divot tool, and a ball marker. The soft pouch has hook and loop patches for closure, but can use snaps, a zipper or buttons. The pouch is attached to a belt by either a belt loop, a clip or a hook and loop strip. The pouch is distinguishable for being restricted to a belt without provision for attaching any article by hook and loop fastening material.

U.S. Pat. No. 4,399,934 issued on Aug. 23, 1983, to Colyer L. Dupont describes a belt attached carrier comprising a tube adapted to carry a pocket knife, a mace container and the like looped around the belt with a hook and loop closure means on the bottom. The device is distinguishable for its limitation to carrying cylindrical items from the belt.

U.S. Design Pat. No. 329,744 issued on Sep. 29, 1992, to Joseph A. Moore describes a golf bag tag and glove holder attachment device comprising two spring clips attached to a loop strip which is attached to a round plate having another strap attached opposite the first strap. The device is distinguishable for requiring spring clips for presumably holding the gloves, a round plate and attachment straps.

U.K. Pat. Application No. 227,180 published on Jan. 8, 1925, for Percival C. Cannon describes a canvas bag or pocket for golf bags adapted to be detachably connected thereto, having a closure flap having a sponge for cleaning balls, and permit any desired golf ball to be removed transversely through rubber rings in the bag or pocket.

U.K. Pat. Application No. 354,464 published on Aug. 13, 1931, describes an improvement to golf bags comprising a belt for personal wear with holders for golf tees and a pocket with a fold-over flap for pencils and a cigarette case.

French Pat. Application No. 2,674,110 published on Sep. 25, 1992, for Pierre Moyere describes a device for transporting skis and ski sticks by buckling the ski articles in a strap having a sliding part.

None of the above devices describe a golf glove holder which is attachable to a golfer's pocket or waistband by a magnetic holder and which also uses hook and loop fastening material to attach the glove to the holder. None of the above inventions and patents, taken either singularly or in combination, is seen to describe the instant invention as claimed. Thus a golf glove saver solving the aforementioned problems is desired.

SUMMARY OF THE INVENTION

The present invention is directed to a wet golf glove holder device comprising an elongated panel of flexible material folded to define two rectangular portions of slightly different sizes. They panel is formed by two identical sized layers of leather and plastic sewn together, wherein the top or outer plastic layer has a hook or loop fastening patch on the smaller portion, and the bottom leather layer has a magnet included in each portion. The completed device is folded between the two rectangular portions with the larger portion placed inside a pocket or over a belt, and exposing the hook or loop fastening patch for attaching the wet golf glove. The enclosed magnets attract each other whether in a pocket or on a belt to secure the device in its location.

Accordingly, it is a principal object of the invention to provide a device for airing and drying wet golf gloves.

It is another object of the invention to provide a device for airing and drying a wet golf glove during play.

It is a further object of the invention to provide a device for airing and drying a wet golf glove on the golfer's belt.

Still another object of the invention is to provide a device for airing and drying a wet golf glove outside the golfer's pocket.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
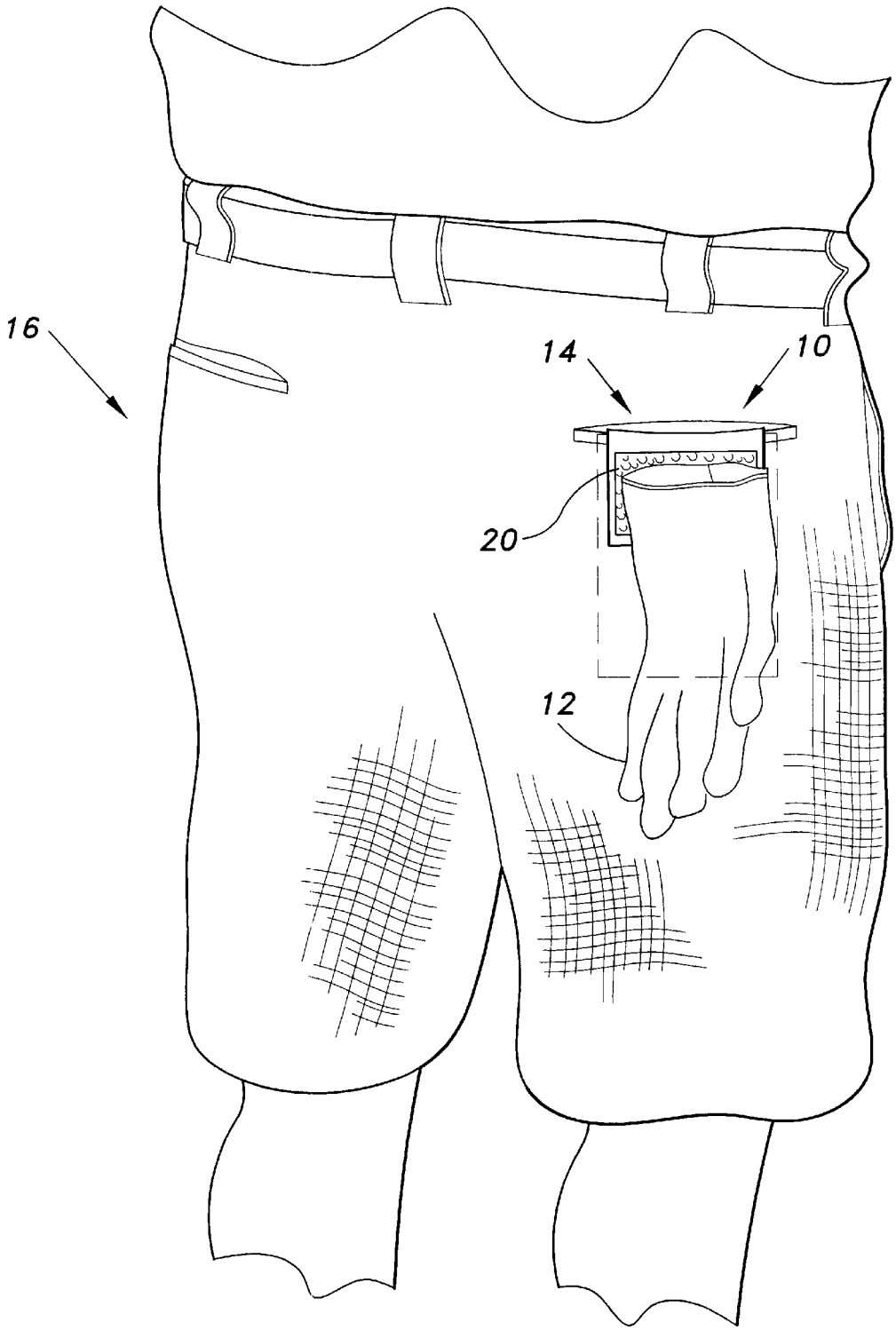
FIG. 1 is an environmental, perspective view of a golf glove saver device inserted partially in the rear pocket of a golfer to hold a wet glove according to the present invention.
Figure 2:
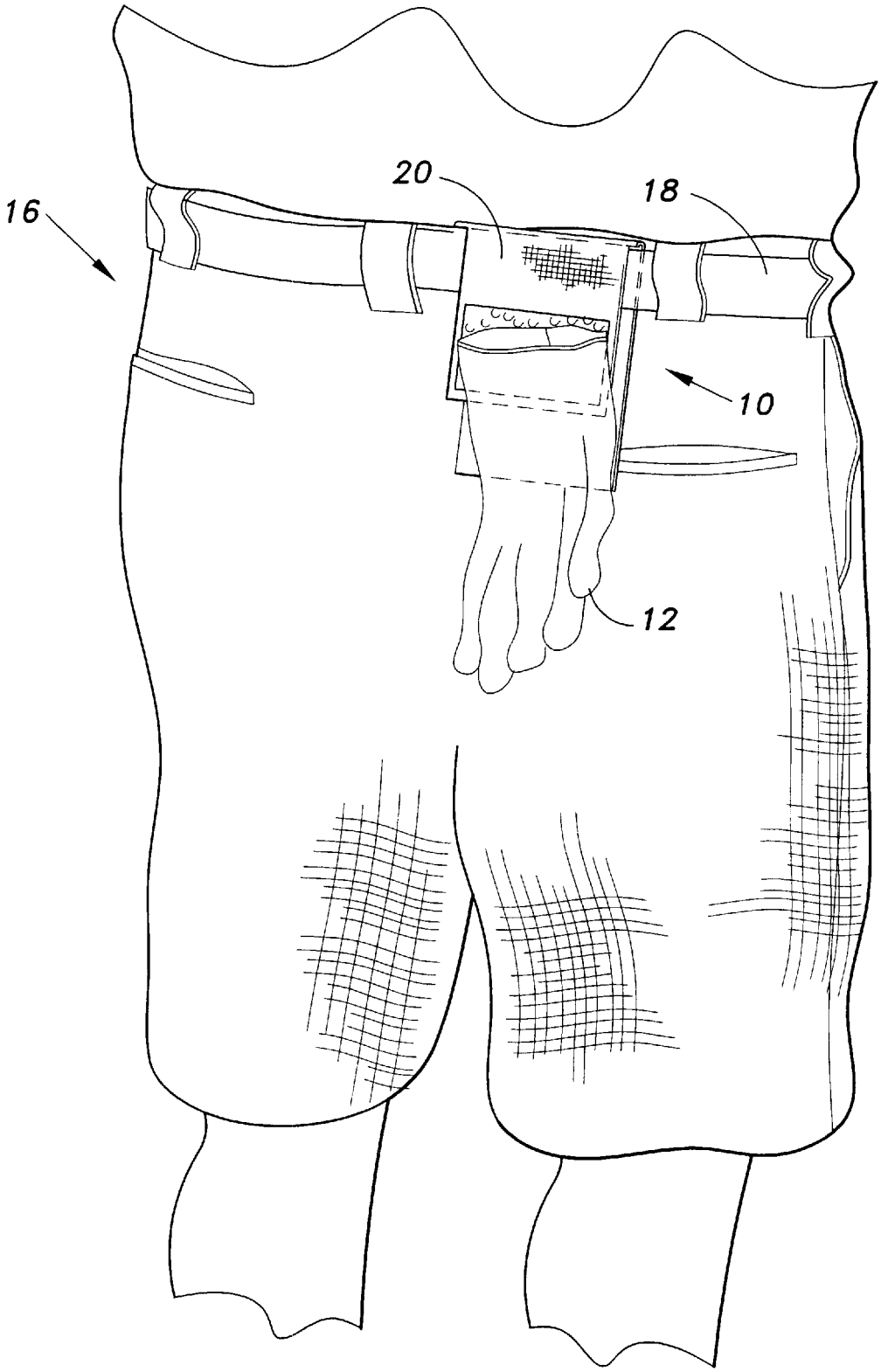
FIG. 2 is an environmental perspective view of the golf glove holder around the belt of a golfer.

In FIG. 1, the present invention is directed to a golf glove saver and drier device 10 being utilized to carry a wet golf glove 12 by inserting one portion of the device 10 inside a back pocket 14 of a golf player 16 and attaching the glove 12 to the portion of the device 10 outside the pocket 14. In FIG. 2, another location for hanging the device 10 would be over the belt 18, or over the waistband of the golfer's pants. Conventional modern golf gloves now have hook and loop patches on opposite sides of the wrist closure flaps (not shown) which can be overlapped to effect a tight or loose closure. This effect is taken advantage of in this invention to utilize partial overlapping of the hook and loop patches on the glove to act as the cooperating fastening for attaching to the hook and loop fastening patch on the device 10. It is preferred to expose the hook portion of the glove 12 to attach to the softer loop fastening patch 20 of the device 10 shown in FIGS. 1 through 4, although the opposite arrangement is within the scope of the invention.

Figure 3:
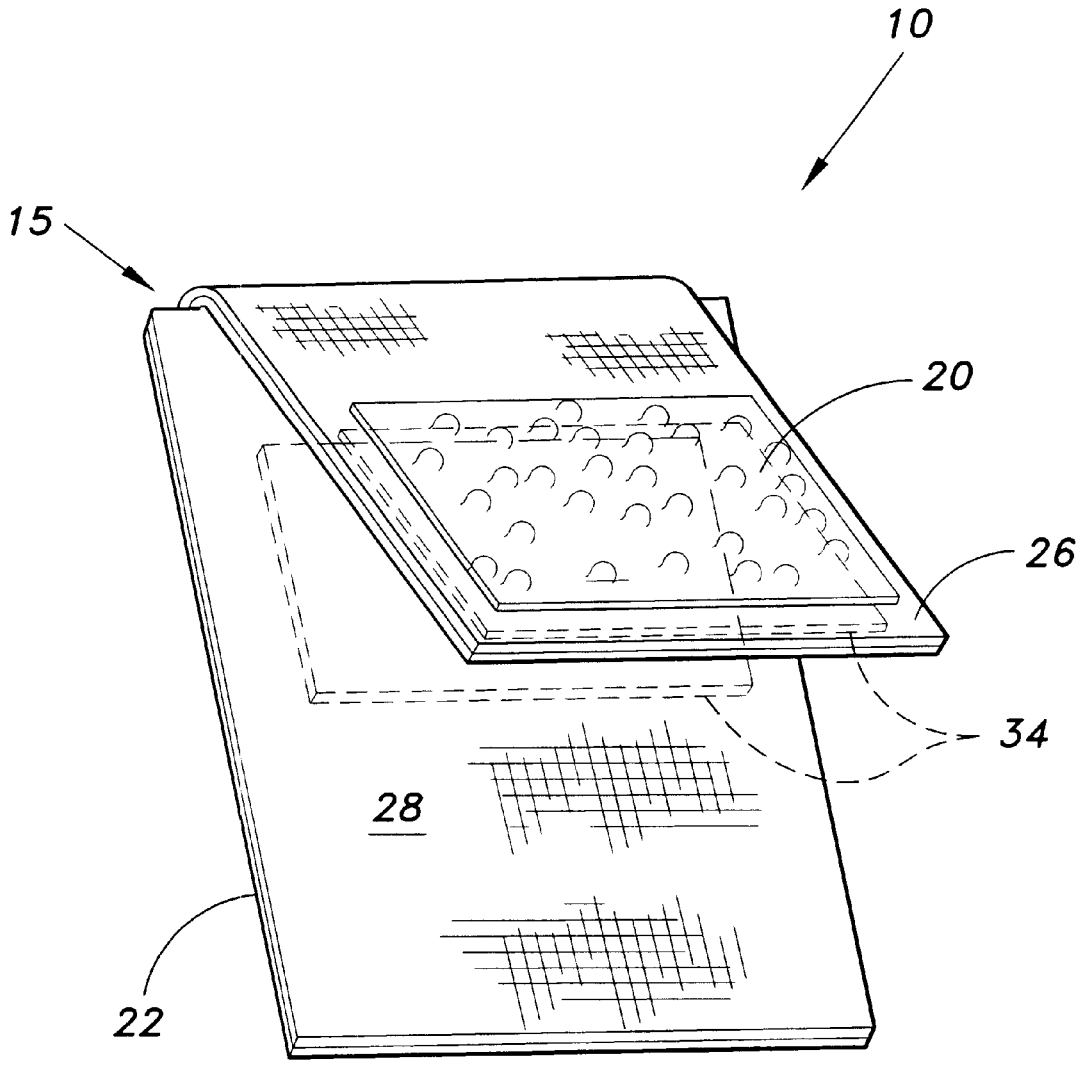
FIG. 3 is a perspective view of a partially folded golf glove holder.
Figure 5:
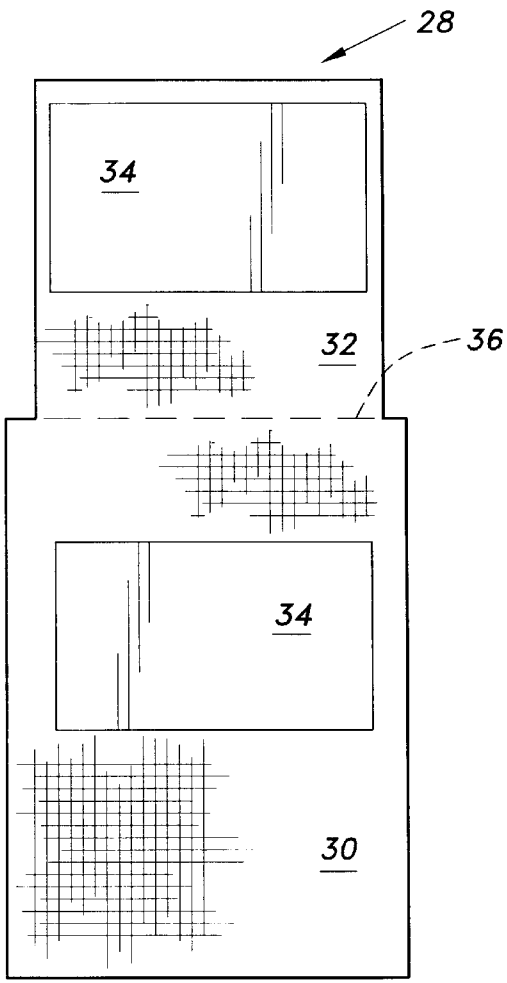
FIG. 5 is a front elevational view of the inner face of the bottom piece having two magnets attached.
Figure 4:
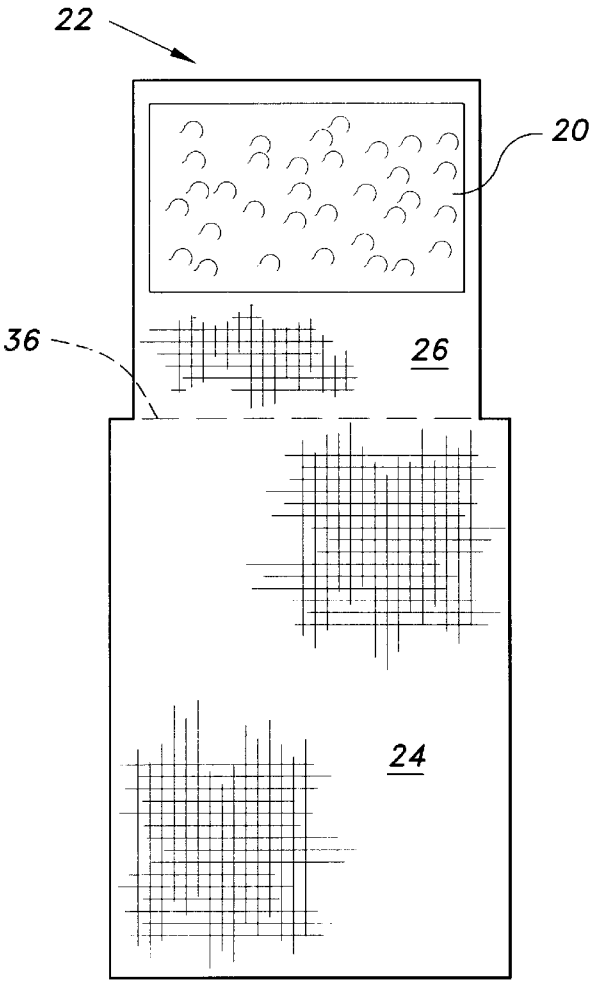
FIG. 4 is a front elevational view of the outer face of the top piece showing a square hook or loop fastening patch.

Now with reference to FIGS. 3, 4 and 5, the fabrication of the device 10 will be explained. In FIG. 3, the fabricated device 10 is shown to include a folded elongated panel 15 comprising a first layer 22 (FIG. 4) and a second layer 28 (FIG. 5). Layer 22 is a substantially rectangular piece of flexible material, preferably plastic, having a first rectangular portion 24 (bottom) and a second rectangular portion 26 smaller in length and width (top). A hook and loop fastening patch 20 (preferably the softer loop) is positioned on the outer face of the second rectangular portion 26.

Layer 28 is a substantially rectangular piece of flexible material, preferably leather, having dimensions and a configuration identical to layer 22 and including a first rectangular portion 30 and a dimensionally smaller second rectangular portion 32. Magnets 34 of any shape are attached to the inner face of the first rectangular bottom portion 30 and to the inner face of the second rectangular top portion 32 of the layer 28 by adhesive or other means. The magnets 34 are attached with their poles oriented so that the magnets will attract each other when the second piece 28 is folded about the juncture or fold line 36. Subsequently, the first and second layers 22, 28 are combined by sewing along the outside edges to form folded panel 15, as shown in FIG. 3, such that the hook or loop fastening patch 20 is exposed and the magnets 34 are enclosed within layers 22 and 28. The device 10 can now be folded at the juncture 36 of the first and second rectangular portions 30 and 32, respectively, whereby the magnets 34 will coincide to secure the device 10 around a golfer's belt 18 (FIG. 2) or in a rear pocket 14 (FIG. 1) with the hook and loop fastening material 20 exposed for attachment of a wet golfer's glove 12 to aid in drying out during play on a golf course.

The advantages of this device are manifold. The use of magnets eliminates the disadvantages of snaps, loops, metal clips and the like from damaging the golfer's clothing. The device is economical to produce and durable. The use of wet gloves involves wrinkling of gloves placed in the pockets due to inadequate ventilation. The salt content of perspiration deteriorates the glove and decreases its lifetime. Moreover, using a wet glove makes the glove slippery to wear and aggravating. By using the device, the golfer can readily attach and remove the wet glove to air it and save on the buying of new gloves.

It should be understood that although the device 10 has been described as being made from leather and plastic, fabric material, natural or synthetic, can be used to form the device 10.

It is to be understood that the present invention is not limited to the embodiments described above, but encompasses any and all embodiments within the scope of the following claims.

We claim:

1. A golf glove saver and drier device consisting of:

an elongated, substantially rectangular panel having a first layer of flexible plastic material and a second layer of flexible leather material, said first layer and said second layer having corresponding peripheral edges and being connected about the peripheral edges, said panel being foldable about a fold line to define an upper rectangular portion and a lower rectangular portion, the upper rectangular portion including an outer face of said first layer of plastic material and being dimensionally smaller than the lower rectangular portion;

a first magnet disposed within the upper rectangular portion between said first layer and said second layer;

a second magnet disposed within the lower rectangular portion between said first layer and said second layer; and a patch of hook and loop fastening material disposed on the outer face of the upper rectangular portion;

whereby said device is adapted to be folded about an item of a golfer's clothing to expose the outer face of the upper rectangular portion, such that the first and second magnets attract each other for securing the device to the clothing with the patch of hook and loop fastening material being exposed for attachment of a golf glove.

2. The device according to claim 1, wherein the first magnet and second magnet are of similar size and shape.

3. The device according to claim 1, wherein the lower rectangular portion of said panel is adapted for insertion in a back pocket and for being held in position by the magnets.

4. The device according to claim 1, wherein the lower rectangular portion of said panel is adapted for being tucked over and behind a belt and held in position by the magnets.

* * * * *